US006006692A

United States Patent [19]

Szukhent, Jr.

[11] Patent Number: 6,006,692

[45] Date of Patent: Dec. 28, 1999

[54] BOAT CANOPY MOUNTING APPARATUS

[76] Inventor: Steve Szukhent, Jr., 3475 Williamson, Saginaw, Mich. 48601

[21] Appl. No.: 09/014,883

[22] Filed: Jan. 28, 1998

[51] Int. Cl.[6] ..... E04A 15/34

[52] U.S. Cl. ..... 114/361; 114/361; 114/361.2

[58] Field of Search ..... 114/361; 135/88.01, 135/88.02, 88.03, 88.04, 88.13, 121, 122; 296/136

[56] References Cited

U.S. PATENT DOCUMENTS

| | | | |
|---|---|---|---|
| 3,367,349 | 2/1968 | O'Link | 135/6 |
| 4,993,351 | 2/1991 | Zirkelbach et al. | 114/361 |
| 5,224,306 | 7/1993 | Cramer | 135/121 |
| 5,303,667 | 4/1994 | Zirkelbach et al. | 114/361 |
| 5,331,993 | 7/1994 | Billbury | 135/119 |
| 5,339,763 | 8/1994 | Erskine | 114/361 |
| 5,343,824 | 9/1994 | Floyd | 114/361 |
| 5,396,861 | 3/1995 | Acker et al. | 114/361 |
| 5,425,327 | 6/1995 | Zirkelbach et al. | 114/361 |
| 5,803,104 | 9/1998 | Pollen | 135/88.03 |

*Primary Examiner*—Jesus D. Sotelo
*Attorney, Agent, or Firm*—John J. Swartz

[57] ABSTRACT

Apparatus for mounting a boat canvas to a boat including a tubular frame member adapted to be mounted on the boat. The hollow tubular frame member includes a plurality of angularly related walls having elongate edges. The elongate edges of at least one of the walls is coupled to the adjacent elongate edges of the two adjacent walls with a pair of U-shaped troughs which, together with the one wall, forms a track. A U-shaped, fastener mounting member is slidably received on the track and includes a base having a pair of legs extending therefrom and slidably received in the troughs. A male fastening member is coupled to one of the canopy and the slide and a cooperating, complementally shaped female fastening member is coupled to the other of the canopy and the slide. If desired, a similar trough may couple the elongate edges of each wall to the adjacent elongate edges of each adjacent wall and additional U-shaped slides may be slidably mounted on another of the walls.

27 Claims, 2 Drawing Sheets

BOAT CANOPY MOUNTING APPARATUS

BACKGROUND OF THE INVENTION

1. Field of the Invention

This invention relates to apparatus for mounting a canopy to a boat and more particularly to a canvas mounting boat top frame for adjustably mounting snap fasteners detachably coupled to a boat canvas.

2. Description of the Prior Art and Objects

Boat canopies and mooring covers, which are typically formed of canvas, are detachably coupled to a boat with a plurality of fasteners each including a male fastening member attached to the boat surface and a complementally formed female fastener attached to the boat canopy or mooring cover. As the canvas ages, it shrinks and thus, it is difficult and time consuming to stretch the canvas so that the canvas mounted female fasteners will be properly aligned with the male fasteners mounted on the boat. Accordingly, it is an object of the present invention to provide new and novel mechanism for attaching a sheet of fabric, such as a boat cover, to an object, such as a boat.

It is another object of the present invention to provide a new and novel frame for mounting a cover on a boat.

Yet another object of the present invention to provide apparatus for attaching a cover to a boat including new and novel mechanism for slidably mounting a male snap fastener to a boat for receiving a complementally formed female snap fastener on a boat cover.

Traditionally, a canopy mounting framework includes a plurality of tubes forming the upper frame of the convertible top frame. If desired, the tubes may be articulately coupled together to provide a convertible top. The cover or canopy is draped over, but not attached to the frame and thus, sometimes, due to high winds, the cover can be detached from the boat and boat frame. Accordingly, it is a further object of the present invention to provide new and novel apparatus for securely attaching a canopy to a hollow tubular boat frame from the frame.

It is yet another object of the present invention to provide a new and novel boat cover mounting frame which will increase the force required to detach the cover.

It is another object of the present invention to provide a boat cover mounting frame which will better insure that the cover remains on the boat and is not inadvertently dislodged.

The U.S. Pat. No. 3,367,349 issued to Maurice H. O'Link on Feb. 6, 1968, discloses an aluminum extruded solid rail formed with grooves for receiving a slide which mounts a female snap fastener. This construction requires the installation of a separate rail and does not facilitate coupling the canvas to the hollow tubular fame work typically associated with many smaller boats. U.S. Pat. No. 5,343,824 issued to Richard S. Floyd on Sep. 6, 1994, similarly discloses a rail which is mounted on the surface of a canoe mounts a slide having a pair of T-shaped bars that clamp a canvas to a pair of complementally formed T-shaped slots provided in an outer rail to sandwich the edge of the cover therebetween. Accordingly, it is an object of the present invention to provide new and novel hollow boat cover framework for detachably coupling a boat cover to a hollow frame work mounted on a boat.

It is another object of the present invention to provide a new and novel hollow tubular frame work on which fastener mounting slides can be slidably mounted for movement to any selected one of a plurality of different positions to receive complementally formed fasteners attached to the boat cover.

U.S. Pat. No. 5,331,993 issued to Ronald R. Billbury on Jul. 26, 1994, discloses a cover fastening device including a U-shaped slide which surrounds three sides of a square shaped tubing that is fastened to the surface of the boat. This construction is limited in its use and versatility since the U-shaped slide includes inwardly offset terminal ends that extend along a portion of the fourth side of the tubular member and thus, interferes with utilizing multiple sides of the tubular frame for multiple purposes. It is sometimes is desirable to mount curtains, a coat hook or other paraphernalia on the inside of a canopy. With the Billbury construction, the fastening device encompasses three sides and extends into the fourth side of the square and thus restricts the use of the tubing. Accordingly, it is another object of the present invention to provide new and novel hollow, multi sided boat frame which utilizes only one of the sides to mount the cover.

It is another object of the present invention to provide a boat cover mounting frame which will enhance the mounting of various objects from different sides of the framework.

It is another object of the present invention to provide boat canopy mounting apparatus of the type described which will facilitate the mounting of multiple slides on multiple sides of a tubular frame work for mounting the canopy on one side of the tubular frame and another object on an opposite side of the tubular frame work.

Yet another object of the present invention is to provide a new and novel frame for mounting a cover on a boat including a hollow elongate tube having a plurality of angularly related wall panels each having elongate edges and a pair of elongate troughs integrally coupling the elongate edges of one of the panels to the adjacent elongate edges of the two adjacent panels to provide a track for slidably receiving a cover fastener mounting slide.

It is a further object of the present invention to provide a new and novel mechanism for coupling a portion of a convertible boat canopy to a convertible hollow tubular convertible top frame.

Another object of the present invention is to provide a new and novel frame for mounting a boat cover on a boat including a tubular member having a new and novel cross section.

Yet another object of the present invention is to provide a new and novel frame for mounting a cover on a boat including a track formed in one of the side walls of a hollow tubular member.

Still another object of the present invention to provide a new and novel frame of the type described including a pair of oppositely disposed elongate tracks formed on opposite sides of an elongate tubular frame member.

Other objects and advantages of the present invention will become apparent to those of ordinary skill in the art as the description thereof proceeds.

SUMMARY OF THE INVENTION

A framework for detachably mounting a flexible sheet of material, such as a boat canopy, to an object, such as a boat, comprising: a hollow elongate tubular member having a plurality of elongate, angularly related side wall panels each having laterally spaced, elongate edges, and a pair of elongate troughs integrally coupling the elongate edges of at least one of the panels to the adjacent elongate edges of the two adjacent panels to provide a track for slidably receiving a cover fastener mounting slide.

DESCRIPTION OF THE DRAWINGS

The invention may be more readily understood by referring to the accompanying drawings, in which.

DESCRIPTION OF PREFERRED EMBODIMENT

Figure 1:
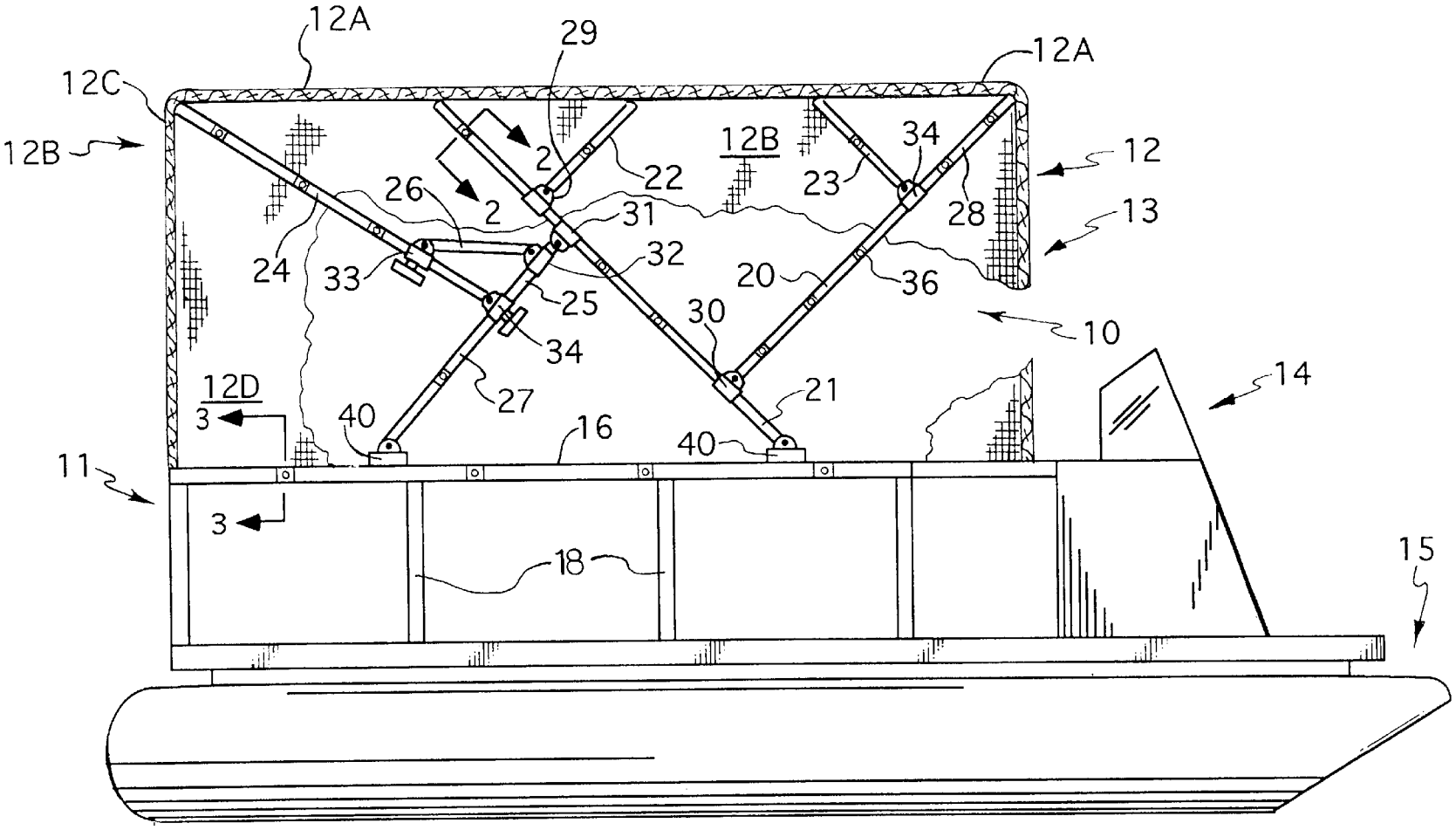
FIG. 1 is a side elevational view of a frame work, constructed according to the present invention, for mounting a cover, part of which is broken away to more clearly illustrate the framework, on a boat.

Apparatus, generally designated 10, constructed according to the present invention, is particularly adapted for use in mounting a boat cover canopy or canvas, generally designated 12, on a boat, generally designated 14 having a hull 15. The apparatus 10 includes a lower base frame, generally designated 11, and an upper, articulated foldable frame, generally designated 13, articulately mounted on the lower frame 11. The cover 12 includes a top wall 12A and an integral dependent skirt, generally designated 12B, having upper and lower sidewall portions 12C and 12D.

The lower frame 11 includes a hollow extruded tubular aluminum rail, generally designated 16, mounted on the hull 15 with a plurality of upstanding vertical hollow aluminum frame bars 18.

The upper frame 13 includes a plurality of generally hollow, extruded aluminum tubes 20–27 inter connected via slides 28–33 and hinge pins 34. The lowermost hollow tubes 21 are mounted on the lower horizontal hollow tubes 16 via hinge pins 40 for swinging movement between the boat covering position covering illustrated in FIG. 1 and a collapsed position.

The tube 16 includes four wall panels 42, 44, 46 and 48 each having elongate parallel lateral edges 42A, 42B; 44A, 44B; 46A, 46B; 48A and 48B, respectively. The elongate lateral edges 48A and 48B are integrally coupled to the adjacent lateral edges 46B and 42A, respectively, of the adjacent panels 46 and 42, respectively, via a pair of curvilinear or U-shaped troughs or generally designated 50 and 52, which provide outwardly opening, recessed slots, indents, or tracks 54 and 56, respectively, for receiving a slide fastener, generally designated 60.

The canvas or canopy 12 includes lower terminal side skirt edges 12D which are detachably coupled to the rail 16 via a fastener, generally designated 60, having a female snap fastener 62 coupled to the canvas 58 via a rivet 64. The fastener 60 includes a complementally formed male snap fastener 66 which detachably mounts on the female snap fastener 62.

Slide mechanism, generally designated 68, is provided for mounting the male snap fastener 66 on the tracks 54 and 56 and includes a U-shaped slide, generally designated 70, having a base 72 mounting a pair of curvilinear legs 74 having detent which are slidably received in the troughs or indents or slots 54 and 56. The male fastener 66 is coupled to the base 72 of the U-shaped slide 70, via a rivet 78. The slides 68 can move along the tracks 54 and 56 to dispose the male fastener 66 in alignment with the female fastener 62.

Figure 2:
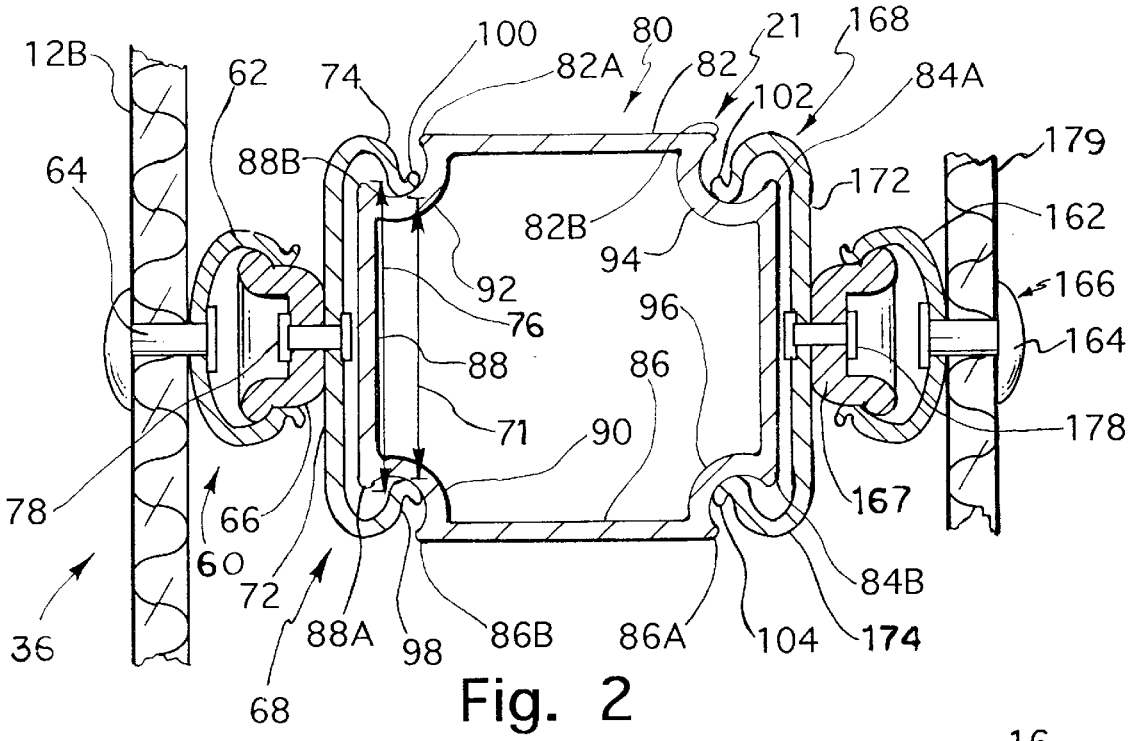
FIG. 2 is a greatly enlarged sectional view, taken along the section line 2—2 of FIG. 1, more particularly illustrating apparatus constructed according to the present invention for mounting an upper portion of a boat cover to a boat.

Each of the links 20, 21, 22, 23, 24, 26 and 27 of the upper fame 13 are formed from an extruded elongate tube, generally designated 80, which is more particularly illustrated in FIG. 2.

Each of the hollow tubes 20–27 is extruded from a one piece aluminum stock including four walls or wall panels 82, 84, 86 and 88 which are disposed at right angles or normal to each of the adjacent walls. As illustrated, the inner and outer walls 84 and 88, respectively, are parallel to each and the upper and lower walls 82 and 86, respectively, are also parallel to each other. The panels 82, 84, 86 and 88 include elongate parallel edges 82A, 82B; 84A, 84B; 86A, 86B; 88A and 88B, respectively. The elongate edges 88A, 82A, 84A and 86A are integrally coupled to the adjacent elongate edges 86B, 88B, 82B and 84B, respectively, via U-shaped curvilinear indents or troughs 90, 92, 94 and 96, respectively. The troughs 90, 92, 94, and 96 define outwardly opening slots or tracks 98, 100, 102 and 104, respectively. The legs 74 of the U-shaped slides 68, coupled to the upper side wall portion 12C of the canvas 12, are slidingly received in the slots 98 and 100 of troughs 90 and 92, respectively.

Additional fasteners, generally designated 166, are mounted on the oppositely disposed tracks defined by the troughs 94, 96 and wall 84 via a U-shaped clip, generally designated 168, having a base 172 integrally mounting curvilinear legs 174 which are slidably received in the troughs 102 and 104. The fastener 166 includes a male fastener 167, coupled to the base 172 via a rivet 178. The fastener 166 also includes a female fastener, generally designated 162, which, in turn, is detachably coupled to the male fastener 166 and also coupled to an accessory, such as a curtain or other paraphernalia schematically 179 via a rivet 164.

The distance 71 between the terminal ends 74A of the legs 74 is less than the distance 76 between the elongate edges 88A and 88B of wall panel 88 so as to be retained in the slots 98 and 100. The slides 68, however, are formed of material which allows the legs 74 to be yieldable relative to the base 72 so as to expand outwardly such that the distance 70 between the terminal leg ends 74A is greater than the distance 76 so as to be snapped thereon and removed therefrom.

The construction thus, not only provides a new and novel frame 11 which allows sliding movement of the male portion 66 of the snap fasteners mounted on the boat, but provides a large number of cover holding members on the foldable frame 13 for securely fastening the cover 12 on the outside thereof and accessories 179 on the inside thereof.

THE OPERATION

With the frame 13 disposed in the position illustrated in FIG. 1 and the canopy or cover 12 draped thereon in the position illustrated in FIG. 1, the upper side wall portion 12C of the cover skirt 12B is detachably coupled to the outside walls 88 of tubes 20–27 via cooperating and complementally formed male and female snap fasteners 66 and 62 as is more particularly illustrated in FIG. 2. The legs 74 are slidingly received in the slots 98 and 100 of troughs 90 and 92, respectively.

Figure 3:
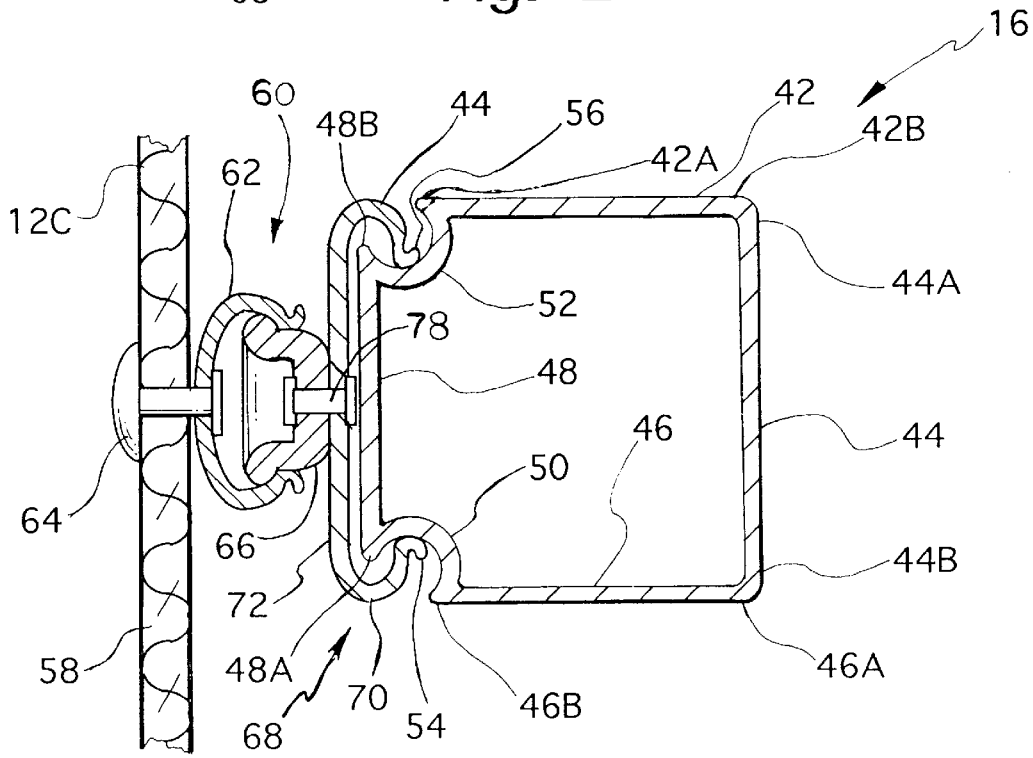
FIG. 3 is a sectional view, similar to FIG. 2 taken along the section line 3—3 of FIG. 1, more particularly illustrating apparatus according to the present invention for mounting a lower terminal cover edge to the boat.

The lower end 12D of the skirt 12B is attached to the outer walls 88 of rail 16 via the complementally formed male and female snap fasteners 66 and 62, respectively, mounted on slides 68 that include legs 74 received in the slots 54 and 56 of troughs 50 and 52, respectively, (FIG. 3).

If desired, curtains or other paraphernalia, generally designated 179, (FIG. 2) may be mounted on the inside walls 84 of the upper tubes 20–27 via complementally formed cooperating male and female fasteners 162 and 156, respectively, mounted on slides 168, respectively, which include legs 174 slidingly inside received in the slots 102 and 104. If it is desired to remove the curtains or decoration 179, the female snaps 162 are merely removed from the male fasteners 66. Likewisely, if it is desired to roll up the sides or skirt 12B, the lower snap fasteners 60 are moved axially away from the male snap fasteners 66 to force the legs 74 to spread and allow the female fasteners 60 to be detached from the male fasteners 66. The additional fasteners provide substantially increased holding force to securing the cover 12 to the boat 14.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Apparatus for detachably mounting a flexible sheet of material, such as a boat cover, to an object, such as a boat comprising:

a hollow, elongate tubular member having a plurality of integral, elongate angularly related side walls enclosing an elongate space;

at least one of said side walls having an elongate track including a base provided with a pair of laterally spaced, elongate lateral edges; and an elongate trough integrally coupled to each of said pair of elongate edges and to an adjacent one of said side walls for receiving terminal edge portions of a slide fastener attached to said sheet.

2. The apparatus set forth in claim 1 wherein a second of said side walls is disposed opposite and generally parallel to said one side wall, and includes a second base and a second pair of U-shaped troughs integrally coupled to said second base and to adjacent ones of said elongate side walls.

3. The apparatus set forth in claim 1 wherein said troughs are U-shaped.

4. The apparatus set forth in claim 1 further including fastener means for coupling to said sheet, and slide means coupled to said fastener means and slidably mounted on said track.

5. The apparatus set forth in claim 4 wherein said slide means has a U-shape and includes a base and a pair of legs coupled to said base, said legs having terminal ends received by said pair of U-shaped troughs.

6. Apparatus for detachably mounting a flexible sheet of material, such as a boat canopy, to an object, such as a boat, comprising:

a hollow, elongate tubular member having a plurality of elongate, angularly related side wall panels each having laterally spaced, elongate edges; and means for forming a track in said tubular member including a pair of laterally spaced longitudinally extending, U-shaped troughs integrally coupling said elongate edges of at least one of said panels to said elongate adjacent edges of the two adjacent panels to provide a track for slidably receiving portions of a slide fastener adapted to be attached to said sheet.

7. The apparatus set forth in claim 6 wherein said hollow tubular member comprises four panels which are disposed normal to the adjacent ones of said panels; said means for forming a track comprises a longitudinally extending trough coupling each edge of each panel to each adjacent edge of each adjacent panel.

8. The apparatus set forth in claim 6 further including fastener means for coupling to said sheet, and slide means coupled to said fastener means and slidably mounted on track.

9. The apparatus set forth in claim 8 wherein said slide means has a U-shape and includes a base and a pair of legs coupled to said base, said legs having terminal ends received by said pair of U-shaped troughs.

10. Apparatus for attaching a sheet of fabric, such as a boat cover, to a boat comprising:

a frame;

means for mounting said frame on a boat;

said frame including an elongate, hollow tubular member;

said tubular member including a plurality of elongate, angularly disposed side wall panels each having elongate side edges;

a pair of elongate troughs integrally coupling said elongate side edge of at least one of said side wall panels to the elongate side edges of the two adjacent side wall panels to form a track; and means for detachably mounting said sheet of fabric to said track.

11. The apparatus set forth in claim 10 wherein said means for detachably mounting said sheet of fabric comprises:

a U-shaped slide for slidably mounting on said track including a base adapted to be disposed in juxtaposition with said one side panel and a pair of legs mounted on said base being slidably received in said troughs;

complementally formed male and female fasteners;

means for mounting one of said fasteners to said sheet of fabric; and means for mounting the other of said fasteners to said base of said U-shaped slide.

12. The apparatus set forth in claim 11 wherein said tubular member includes four of said wall panels, each of said panels being disposed normal to the two adjacent ones of said panels; and further including additional troughs integrally coupling said elongate edges of each panel to the adjacent elongate edges of said two adjacent ones of said panels; and additional U-shaped slide means having legs slidably received in said additional troughs.

13. The apparatus set forth in claim 12 wherein said troughs are each U-shaped.

14. The apparatus set forth in claim 12 wherein said frame comprises a plurality of said tubular members and means coupling said plurality of tubular members for swinging movement relative to each other; and said sheet of fabric comprises a boat canopy having an inside for detachably mounting on said frame for said boat; and additional fastener means is mounted on said additional U-shaped slide means for mounting paraphernalia on the inside of said canopy.

15. The apparatus set forth in claim 10 wherein a second of said side wall panels is disposed opposite and generally parallel to said one side wall panel; and a second pair of elongate troughs integrally couples said elongate edges of said second side wall panel to the two adjacent edges of the two adjacent side wall panels to form a second track parallel to said first mentioned track.

16. The apparatus set forth in claim 15 including first and second fasteners each including a complementally formed male and female fastening members; first and second U-shaped slides for being slidably mounted on said slides; and means for mounting one of said male and female fastener members of each of said fasteners to said sheet of fabric and for mounting the other of said male and female fastening members of each of said fasteners to one of said slides.

17. The apparatus set forth in claim 16 wherein each of said slides includes a base and a pair of legs integral with said base and including terminal ends for being slidably received in said troughs.

18. The apparatus set forth in claim 17 wherein said troughs are U-shaped.

19. The apparatus set forth in 18 wherein said legs of said slide are yieldable relative to said base to allow relative spreading movement thereof between positions in which the distance between said terminal ends is less than the distance between said elongate edges of said one side wall panel to positions in which said distance is greater than said distance between said elongate edges.

20. A frame for mounting a cover on a boat comprising:

a one-piece hollow elongate tube;

means for mounting said tube on a boat;

said tube including a plurality of angularly related wall panels each having elongate edges; and a pair of elongate troughs integrally coupling said elongate edges of at least one of said panels to the adjacent elongate edges of the two adjacent panels to provide a track for slidably receiving a cover fastener mounting slide.

21. The frame set forth in claim 20 wherein one of said troughs integrally couples each elongate edge of each panel to each adjacent elongate edge of each adjacent panel.

22. The frame set forth in claim 20 wherein said troughs are U-shaped.

23. Apparatus for attaching a boat canopy to a boat comprising:

a hollow one-piece tubular frame member, adapted to be mounted on a boat, having a plurality of elongate side walls each having elongate edges; and elongate, curvilinear wall coupling means for coupling said elongate edges of at least one of said walls to the adjacent elongate edges of the two adjacent walls;

said curvilinear wall coupling means forming a pair of elongate troughs for slidably receiving a slide adapted to be coupled to a fastener attached to a boat canopy.

24. Apparatus for attaching a boat canopy to a boat comprising:

a hollow one-piece tubular frame member, adapted to be mounted on a boat, having a plurality of elongate side walls each having elongate edges; and elongate, curvilinear wall coupling means for coupling said elongate edges of at least one of said walls to the adjacent elongate edges of the two adjacent walls; and means for detachably coupling said canopy to said hollow tubular frame member including complementally formed male and female fasteners;

a U-shaped snap slide having a base disposed in juxtaposition with said one wall and a pair of legs mounted on said base and being slidably received by said curvilinear wall coupling means; and means for mounting one of said male and female fasteners to said canopy and for mounting the other of said male and female fasteners on said base of said slide.

25. Apparatus for attaching a boat canopy to a boat comprising:

a hollow one-piece tubular frame member, adapted to be mounted on a boat, having a plurality of elongate side walls each having elongate edges; and elongate, curvilinear wall coupling means for coupling said elongate edges of at least one of said walls to the adjacent elongate edges of the two adjacent walls;

said hollow tubular member including four of said elongate side walls, each of said side walls being disposed at right angles relative to the two adjacent side walls; said elongate curvilinear wall coupling means comprising a trough coupling each elongate edge of each side wall to the adjacent elongate edge of each adjacent side wall.

26. The apparatus set forth in claim 25 including first and second slides each having a base disposed in juxtaposition with opposite ones of said sidewalls and a pair of legs mounted on said base and being slidably received in said troughs coupled to said edges of said opposite ones of said side walls; first and second fasteners each having cooperating male and female fastening members; means mounting one of said male and female fastening members of each fastener to said canopy and mounting the other of said male and female fastening members of each fastener to one of said base of said first and second slides.

27. Apparatus for attaching a boat canopy to a boat comprising:

a hollow one-piece tubular frame member, adapted to be mounted on a boat, having a plurality of elongate side walls each having elongate edges; and elongate, curvilinear wall coupling means for coupling said elongate edges of at least one of said walls to the adjacent elongate edges of the two adjacent walls;

said elongate, curvilinear wall coupling means comprising elongate indents.

* * * * *